United States Patent [19]

Bianchi

[11] 4,270,680

[45] Jun. 2, 1981

[54] THUMB BREAK HOLSTER

[76] Inventor: John E. Bianchi, 1601 Wilt Rd., Fallbrook, Calif. 92029

[21] Appl. No.: 83,359

[22] Filed: Oct. 10, 1979

[51] Int. Cl.[3] ..... B23P 11/02

[52] U.S. Cl. ..... 224/193; 224/198; 224/911

[58] Field of Search ..... 224/193, 192, 198, 243, 224/250, 911

[56] References Cited

U.S. PATENT DOCUMENTS

| | | | |
|---|---|---|---|
| 2,765,968 | 10/1956 | Gaylord, Jr. | 224/198 |
| 2,917,213 | 12/1959 | Bucheimer et al. | 224/243 |
| 4,035,902 | 7/1977 | Bianchi et al. | 224/193 X |
| 4,079,870 | 3/1978 | Clark | 224/911 X |

*Primary Examiner*—Steven M. Pollard
*Attorney, Agent, or Firm*—Wagner & Bachand

[57] ABSTRACT

A thumb break type front opening holster employing a body of leather or leather-like material defining a holster retaining cavity having a top opening for insertion of the weapon into the holster and a front opening for removal of the weapon. The weapon is held in place by a strap secured to the outer side of the holster by a permanent but pivoted connection. The strap includes one-half of a snap fastener at its upper or free end designed to be engaged to a portion of the holster to hold the weapon in place. The mating half of the snap fastener is secured to a relatively rigid pivoted thumb break tab which is secured to the holster at an upper extremity. The thumb break tab is fashioned of leather or leather-like material and mounts the mating snap fastener half for the strap. Contained within the tab is a reinforcement member in the shape of an inverted U with outward extending legs extending laterally beyond the width tab. The legs are located within the belt loop opening of the holster extending through a slot therein. The legs of the reinforcement member are held spaced by the snap fastener.

6 Claims, 10 Drawing Figures

THUMB BREAK HOLSTER

BACKGROUND OF THE INVENTION P The development of front opening holsters has advanced from the earliest work of Hoyt as represented by U.S. Pat. No. 2,037,132, through more recent developments of this inventor which are believed to be responsible for the first truly practical front opening holster designed particularly for police work.

With the development of front opening holsters a secondary problem has arisen in that there is a present need for a device for rapidly and effectively releasing a weapon holding strap. In U.S. Pat. No. 3,630,420, I disclose a strap arrangement in which the officer, by sliding his hand forward, allows the side of his forefinger to release a strap from the outer face of the holster. It has been discovered that such an outer releasable strap provides a temptation if not an effective means for an adverse party to attempt to remove a weapon by first pulling such strap and grasping the weapon. In my co-pending application, Ser. No. 11,418, filed Feb. 12, 1979, I show protective devices for preventing unauthorized removal of the weapon. The need has however continued to be recognized to eliminate the possibility of a weapon being removed after unsnapping the outer end of the strap.

It has been found that to have the outer end of the strap pivoted yet fixedly secured to the holster with what appears to be a snap fastener is advantageous. It has been found that the thumb advances upon drawing beyond the weapon ahead of the forefinger thus it is better if the thumb somehow can release the retainer strap. This has been accomplished in the past including snap fasteners secured to the inner side of the holster to be released by the thumb during the forward drawing movement. Holsters of this type are termed thumb break holsters.

BRIEF STATEMENT OF THE INVENTION

I have discovered that producing a truly practical thumb break holster is much more difficult than one would anticipate. In particular it is not desired that there be any slowing movement of the weapon forward as the thumb attempts to disengage the strap. This leads one to feel that a relatively rigid securement point for the fixed half of the snap fastener is desired. Fixed or rigid mounting usually entails exposed metal or plastic securement, and with the snap fastener in such position that it can rub or abrade the metal of the weapon. Thus, metal and plastic retainers for the fixed half of the snap fastener are not desired.

Employing leather retainers or tabs lacks the stiffness and smoothness of release which is desired.

Based with the foregoing prior art and statement of the problem, I have developed an improved thumb break holster employing a metal reinforced leather thumb break tab. The thumb break tab is mounted with respect to the holster body for pivotable movement inwardly away from the weapon upon drawing. The thumb break tab arrangement of my invention also involves the mounting of the thumb break tab merely via an elongated slot in the holster body adjacent to the belt loop opening.

My invention involves the use of leather covered U-shaped reinforcement member having a pair of outward extending legs which pass through a restricted opening in the holster body, namely, the belt loop portion, and act as hinge pins to allow the entire tab assembly to pivot into engagement with strap and out of engagement during drawing.

I have developed an improved assembly method whereby the tab and U-shaped reinforcement member are partially assembled, the legs compressed inward to allow one to pass through a restricted opening in the holster body and then to be spread outward into fixed permanent pivotable operation when the fastener is secured to the tab between the legs of the U-shaped member. The U-shaped member is thus secured to the tab and the tab pivotably secured to the holster body.

The wire pivot U shaped member extends only into the immediate top region of the belt loop causing minimum interference with the belt. This is in contrast with some prior art tabs which are riveted in the belt loop opening. The tab is removable and replaceable if required.

BRIEF DESCRIPTION OF THE DRAWINGS

The foregoing invention may be more clearly understood with the following detailed description and by reference to the drawing in which.

DETAILED DESCRIPTION OF THE INVENTION

Figure 1:
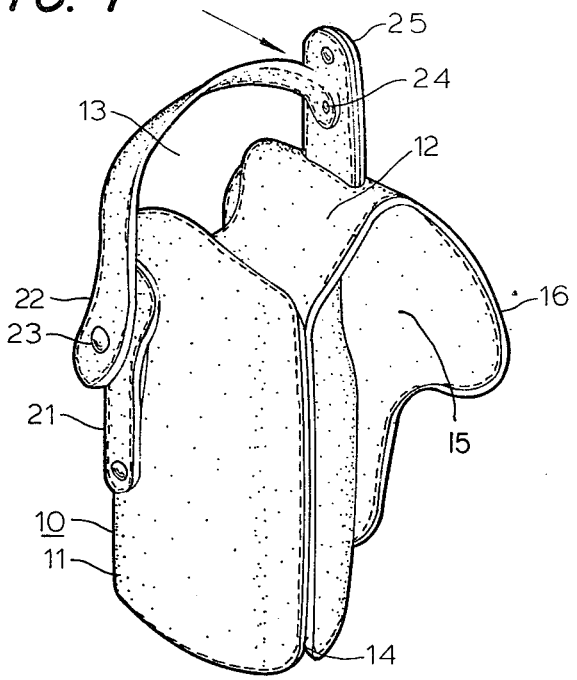
FIG. 1 is a perspective view of a thumb break type front opening holster incorporating this invention.
Figure 3:
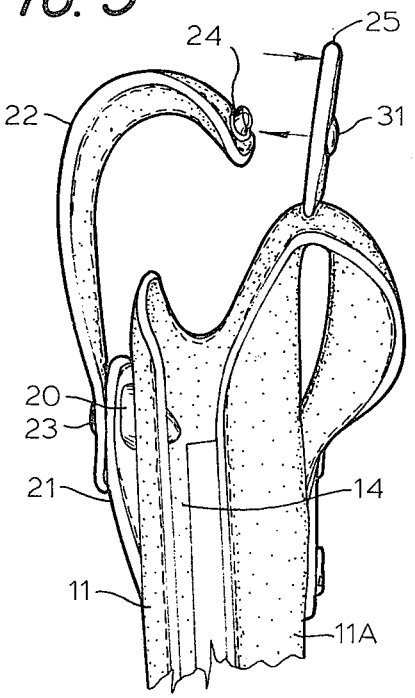
FIG. 3 is a fragmentary front elevational view of FIG. 1 in the position in which it is found during the process of front drawing of a weapon.
Figure 6:
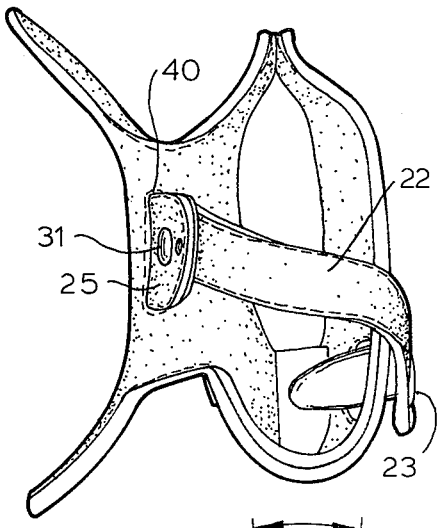
FIG. 6 is a fragmentary top elevational view thereof.

Now referring to FIG. 1 a front opening holster 10 incorporating this invention is disclosed. This holster is of the type which is further disclosed is detailed in my aforementioned patent and in my copending application Ser. No. 11,420 filed Feb. 12, 1979. Reference to them should be made for the details of the design and operation of the holster. Suffice it to say it employs a body of leather or leather-like material 11 formed to define a hand gun carrying cavity 12 with an upper opening 13 through which the hand gun is introduced and a front opening 14 between the edges or lips of the front of the holster. An integral belt loop 15 is defined by a folded over portion 16 also formed integrally with the body of the holster. A spring loaded weapon retainer unshown in FIG. 1 but appearing as 20 in FIGS. 3 and 6 is secured by a spring assembly 21 on the outer face of the holster. A strap 22 is secured by a pivotable fastener 23 which is in turn secured to the spring 21. The strap 22 and its upper hand region includes a snap fastener 24 which is disengageable from a thumb break tab 25 by pressure of the thumb of the user on forward movement on the drawing operation where the thumb travels in the direction and location of the arrow of FIG. 1. The thumb break tab 25 is relatively rigid yet pivotable about the portion of the body defining the upper extremity of the belt loop 15.

Figure 2:
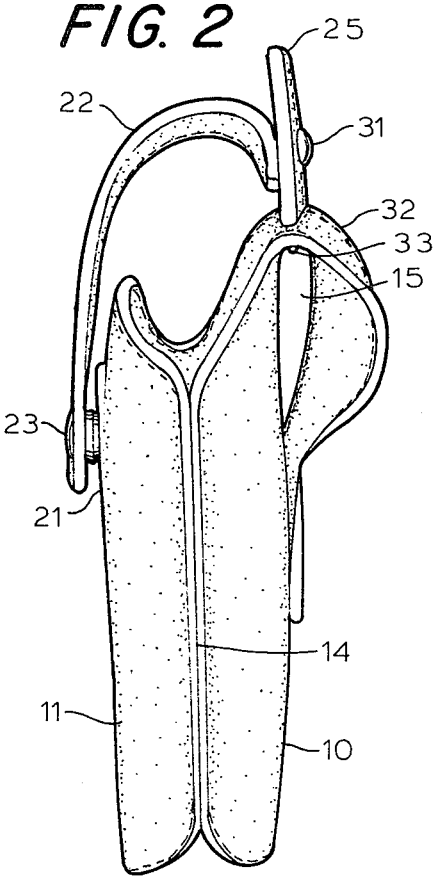
FIG. 2 is a front elevational view thereof.

Now referring to FIG. 2 the holster shown in its normal condition on a belt 30 which extends through the belt loop opening 15. The strap 22 is in its position with the fastener tab 24 secured to its mating half 31 located on tab 25. The fastener 24 is desirably secured through one of the two thicknesses of leather making up strap 22 so that no portion of the metal is exposed on the inner side of strap 22 where it would otherwise mar the finish of the hand gun and perhaps provide unnecessary wear. The tab 25 may be seen as being secured to the holster body in the region 32 which is the upper most portion of the body 11 defining the belt loop opening 15. Extending in the forward direction within the belt loop 15 is a circular metal leg 33 constituting the pivotable member which allows tab 25 to pivot. This is more clearly apparent in FIGS. 3 and 4.

Figure 4:
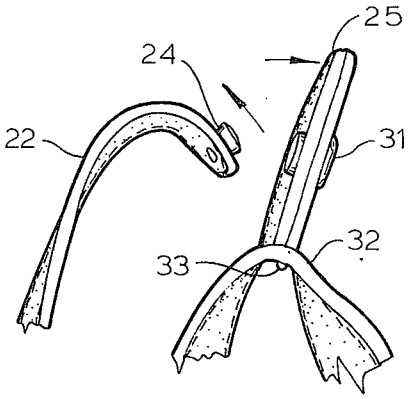
FIG. 4 is a fragmentary view showing the directions of relative movement of the tab and strap during drawing.

Now referring specifically to FIGS. 3 and 4, the strap 22 is separable from the tab 25 by disengagement of the fastener 24 from its mating half 31. As shown in FIG. 4 the disengagement action occurs by outward pivotal movement of the tab 25 about the wire leg 33 at area 32 of the belt loop. Strap 22 moves outward away from tab 25 in the direction of the arrow adjacent to the fastener 24. These two forms of movement are the result of the user's placement of his thumb therebetween as indicated by the arrow in FIG. 1.

Upon release of the strap 22 and movement of the tab 25 outward, the hand gun then may be removed from the holster by forward movement opening the jaws defined by the holster body part 11 and 11A opening the front jaws 14. The strap 22 normally tends to pivot forward by its rotatable fastener 23 to clear the opening 14. Such movement is illustrated in FIG. 3.

Another form of securement of the hand gun in FIG. 3 namely the obstruction 20 which is designed to normally fall into the trigger guard opening of the hand gun when the hand gun is holstered and to move out of the way on its spring carrier 21 upon front drawing of the weapon. The details of the design and operation of this feature are best illustrated in my co-pending application referenced above and its operation is relatively independent of the tab member 25 related to the subject of this invention. It is apparent however from FIG. 3 that outward movement of this spring 21 carrying fastener 23 also tends to cause the strap 22 to clear the opening 14 so that strap 22 does not interfere with front drawing of the weapon.

Figure 5:
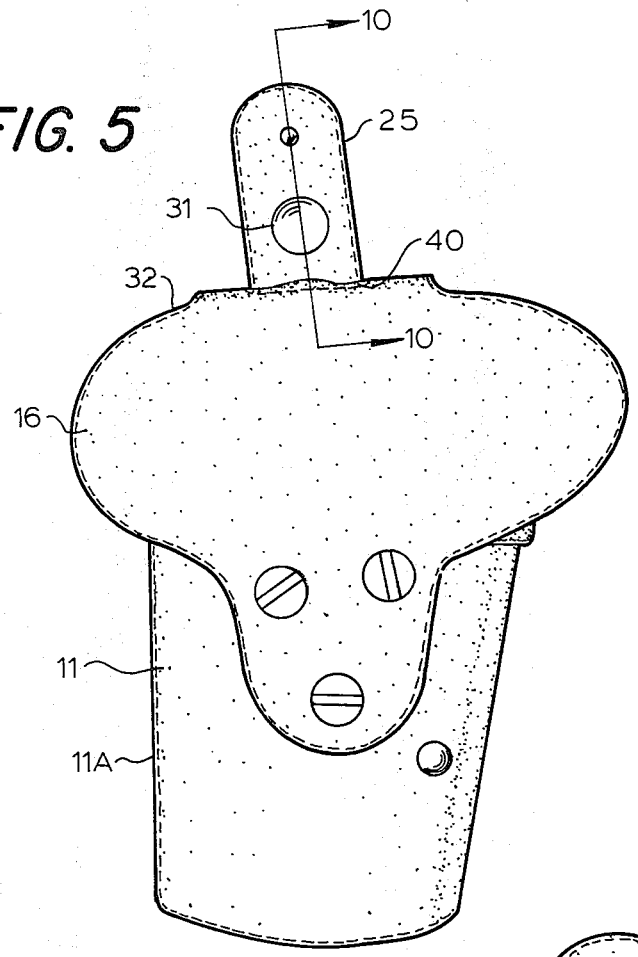
FIG. 5 is a rear elevational view of a holster incorporating this invention.
Figure 9:
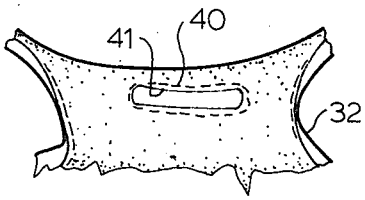
FIG. 9 is a fragmentary top view showing the slots in the holster body designed to receive the legs of the tab.

The rear view of the holster incorporating this invention appears in FIG. 5 and in FIG. 6. It is apparent that tab 25 is separate member from the body defining the body 11 and is upstanding immediately above the holster loop portion of 32. A simple stitch line 40 encircles an opening in the top of the region 32. This opening 41 appears in FIG. 9 and is of length approximating the width of tab 25.

Figure 7:
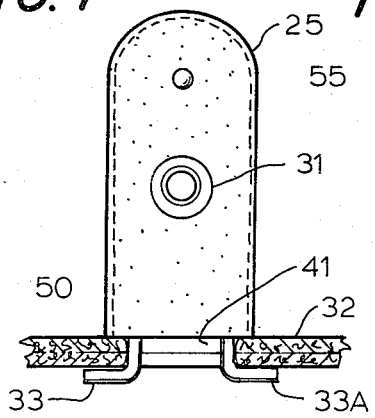
FIG. 7 is a fragmentary vertical section of the tab portion of this invention.
Figure 8:
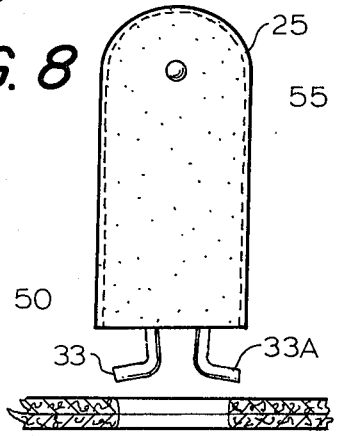
FIG. 8 is an exploded view of the tab assembly and the fragmentary portion of the holster during manufacture.
Figure 10:
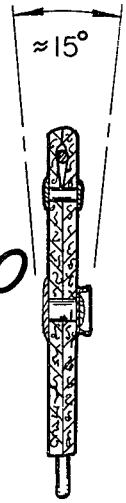
FIG. 10 is a vertical sectional view of the tab assembly of FIG. 5 taken along lines 10—10 of FIG. 5.

The make up of tab 25 is better understood by reference to FIGS. 7, 8, and 10. Tab 25 is of leather or leather-like material but includes an internal reinforcement member in the form of an inverted U reinforcement member 50 having a pair of legs 33 and 33A which extend through the opening 41 of the region 32 of the holster body. The legs 33 and 33A extend beyond the ends opening of 41 thus with the clearance apparent in FIG. 7 allows tab 25 to pivot over a range of approximately 15° as noted in FIG. 10. Of course with increased use with the holster and where this range will increase only providing greater clearance when a weapon is drawn.

Apparent in FIG. 7 is the presence of the snap fastener 31 between the legs of the reinforcement member 50. The snap fastener 31 maintains the legs of the reinforcement apart and thus maintains its permanent connection to the holster body at the opening 41. Once assembled the legs 33 and 33A may not bend inward to slip out of the opening 41.

The assembly of the tab 25 is accomplished by the insertion of the reinforcement member 50 into a pocket defined in tab 25 after the stitch line 55 has been made. The legs 33 and 33A are bent inward either employing a tweezer-like aid or by laterally depressing tab 25. When the legs are once bent inward sufficiently to clear the opening 41 the legs may be inserted through the opening 41 and compressing force removed and the spring characteristic of member 50 causing the legs to assume the normal position as shown in FIG. 7. Next staking the fastener 31 into place permanently secures the tab 25 to the holster body, and legs 33 and 33A outward.

Thus is may be seen that by the design and method of this invention a relatively rigid leather covered tab 25 is achieved. It is pivotable about a known and relatively fixed axis into engagement with the strap 22 and out of the way on drawing. The attachment mode of the tab 25 to the holster involves simply a new elongated slot in the top of the belt loop. The pivoting arrangement toward the tab is merely the the ends of the reinforcement member which into an otherwise un-used portion of the belt loop. The mere installation of the snap fastener to the tab 25 secures the tab 25 to the holster body with no further stitching or assembly.

The above described embodiments of this invention are merely descriptive of its principles and are not to be considered limiting. The scope of this invention instead shall be determined from the scope of the following claims, including their equivalents.

What is claimed is:

1. A thumb break front opening holster comprising:

a body of leather or leatherlike material folded to define a handgun receiving cavity including a top opening for receiving a handgun and a front opening for drawing the handgun;

a belt loop secured to one side of said body for mounting the holster on the belt of a wearer;

a handgun retaining strap secured at one end to the body on the side opposite said belt loop;

relatively rigid tab means separate from said body pivotally secured to a top region of said body adjacent to the top opening thereof, said tab means mounted for pivotal movement toward and away from the top opening of said body;

fastening means comprising a pair of mating parts, one of said parts attached to said tab means and the other of parts secured to said strap; and said fastening means separable by movement of the wearer's thumb forward on drawing of the handgun.

2. The combination in accordance with claim 1 wherein said tab means is pivotally secured to said holster by hinge means engaging said tab means and said holster having an axis extending generally parallel to the length of the belt passage of said belt loop.

3. A thumb break front opening holster comprising:

a body of leather or leatherlike material folded to define a handgun receiving cavity including a top opening for receiving a handgun and a front opening for drawing the handgun;

a belt loop secured to one side of said body for mounting the holder on the belt of the wearer;

a handgun retaining strap secured at one end to the body on the side opposite said belt loop;

relatively rigid tab means separate from said body pivotally secured to a top region of said body adjacent to the top opening thereof, said tab means mounted for pivotal movement toward and away from the top opening of said body;

fastening means comprising a pair of mating parts, one of said parts attached to said tab means and the other of parts secured to said strap;

said fastening means separable by movement of the wearer's thumb forward on drawing of the handgun;

wherein said tab means is pivotally secured to said holster by hinge means engaging said tab means and said holster having an axis extending generally parallel to the length of the belt passage of said belt loop; and wherein said hinge means comprises an inverted U shape wire form secured to said tab with outward extending parallel feet which pivotally engage said belt loop.

4. The combination in accordance with claim 3 wherein said hinge means is enclosed within said tab with said feet extending out to define hinge pivot.

5. The combination in accordance with claim 4 wherein said belt loop includes at least one elongated opening and said feet extend through and beyond the ends of said elongated opening to define a hinged relationship with said belt loop.

6. The combination in accordance with claim 4 wherein said fastening means part secured to said tab extends through the region of said tab between the legs of said hinge means to restrict deformation of said legs after said fastening means part is in place.

* * * * *